US010434359B2

(12) United States Patent
Feng

(10) Patent No.: US 10,434,359 B2
(45) Date of Patent: Oct. 8, 2019

(54) DUMBBELL

(71) Applicant: James Feng, Taichung (TW)

(72) Inventor: James Feng, Taichung (TW)

( * ) Notice: Subject to any disclaimer, the term of this patent is extended or adjusted under 35 U.S.C. 154(b) by 99 days.

(21) Appl. No.: 15/892,453

(22) Filed: Feb. 9, 2018

(65) Prior Publication Data

US 2019/0247698 A1 Aug. 15, 2019

(51) Int. Cl.
*A63B 21/06* (2006.01)
*A63B 21/072* (2006.01)

(52) U.S. Cl.
CPC ..... *A63B 21/0603* (2013.01); *A63B 21/0726* (2013.01)

(58) Field of Classification Search
CPC ..... A63B 21/07; A63B 21/06; A63B 21/05
See application file for complete search history.

(56) References Cited

U.S. PATENT DOCUMENTS 3,311,374 A * 3/1967 Wittenberg ..... A63B 21/0602 482/106
4,029,312 A * 6/1977 Wright ..... A63B 21/0602 482/108
4,538,806 A * 9/1985 Wilkerson ..... A63B 21/0726 482/108
4,854,575 A * 8/1989 Wilson ..... A63B 21/0602 482/108
4,854,576 A * 8/1989 McWain ..... A63B 21/0602 482/106
4,881,736 A * 11/1989 Fox ..... A63B 59/00 473/417
4,997,184 A * 3/1991 Sherman ..... A63B 21/0602 482/108
5,056,778 A * 10/1991 Hull ..... A63B 21/0602 482/105
5,379,909 A * 1/1995 Roark ..... A63B 21/0602 215/10
5,393,284 A * 2/1995 Wesley ..... A63B 21/0602 482/106
5,431,615 A * 7/1995 Correll ..... A63B 21/0602 446/267
5,857,946 A * 1/1999 Brown ..... A63B 21/0602 482/105
6,099,441 A * 8/2000 Bonnet ..... A63B 21/072 482/106
6,200,244 B1 * 3/2001 Cook ..... A63B 21/065 482/105

(Continued)

*Primary Examiner* — Garrett K Atkinson
(74) *Attorney, Agent, or Firm* — Alan D. Kamrath; Mayer & Williams PC

(57) ABSTRACT

A dumbbell has a core rod and a cloth cover. The core rod has a supporting rod and a bag. The bag is mounted around the supporting rod. A first filling space is formed between the supporting rod and the bag. The first filling space is filled with a weight material. The cloth cover is mounted around the core rod and seals the core rod. The cloth cover has a holding portion and two weight portions. The two weight portions are respectively formed at two ends of the holding portion. A second filling space is formed between the core rod and the holding portion. The second filling space is filled with the weight material. A respective third filling space is formed between the core rod and each one of the two weight portions.

12 Claims, 8 Drawing Sheets

(56) References Cited

U.S. PATENT DOCUMENTS

| | | | | |
|---|---|---|---|---|
| 6,224,520 | B1 * | 5/2001 | Hsu | A63B 21/0603 482/107 |
| 6,312,364 | B1 * | 11/2001 | Selsam | A63B 21/06 206/501 |
| 6,582,274 | B1 * | 6/2003 | Chernek | A63H 5/00 446/188 |
| 7,112,178 | B1 * | 9/2006 | Roozenburg | A61H 1/0266 601/121 |
| 9,585,502 | B2 * | 3/2017 | Kang | A47G 19/2205 |
| 2005/0065001 | A1 * | 3/2005 | Su | A63B 21/075 482/106 |
| 2005/0065002 | A1 * | 3/2005 | Su | A63B 21/075 482/106 |
| 2008/0096738 | A1 * | 4/2008 | Kim | A63B 21/0603 482/108 |
| 2010/0173757 | A1 * | 7/2010 | Ma | A63B 21/0552 482/93 |
| 2015/0251043 | A1 * | 9/2015 | Holderbaum | A63B 21/075 482/108 |
| 2017/0282001 | A1 * | 10/2017 | Imbert | A63B 21/0602 |

* cited by examiner

DUMBBELL

BACKGROUND OF THE INVENTION

1. Field of the Invention

The invention relates to a dumbbell, and more particularly to a dumbbell which has an improved appearance and would not damage the wooden floor or furniture.

2. Description of Related Art

A dumbbell is a tool for training muscles with load by weight and includes two kinds: a fixed type and a variable type. The user can select between the two types according to the actual demand when doing muscle training.

As shown in FIG. 8, a conventional dumbbell 90 has two weight portions 91 and a holding portion 92. The holding portion 92 has two ends, and the two weight portions are respectively formed at the two ends of the holding portions 92. A user may hold the holding portion 92 to train the muscles. In addition, many dumbbells are made of metal in order to provide a sufficient load with an appropriate weight. However, the conventional dumbbell is rigid, and the conventional dumbbell may scratch or damage wooden floor or furniture when the conventional dumbbell falls to the ground accidently.

To overcome the shortcomings of the conventional dumbbell, the present invention provides a dumbbell to mitigate or obviate the aforementioned problems.

SUMMARY OF THE INVENTION

The main objective of the present invention is to provide a dumbbell that would not damage the wooden floor or furniture.

The dumbbell has a core rod and a cloth cover. The core rod has a supporting rod and a bag. The bag is mounted around the supporting rod. A first filling space is formed between the supporting rod and the bag. The first filling space is filled with a weight material. The cloth cover is mounted around the core rod and seals the core rod. The cloth cover has a holding portion and two weight portions. The two weight portions are respectively formed at two ends of the holding portion. A second filling space is formed between the core rod and the holding portion. The second filling space is filled with the weight material. A third filling space is formed between the core rod and one of the two weight portions.

Other objects, advantages, and novel features of the invention will become more apparent from the following detailed description when taken in conjunction with the accompanying drawings.

DETAILED DESCRIPTION OF PREFERRED EMBODIMENT

Figure 1:
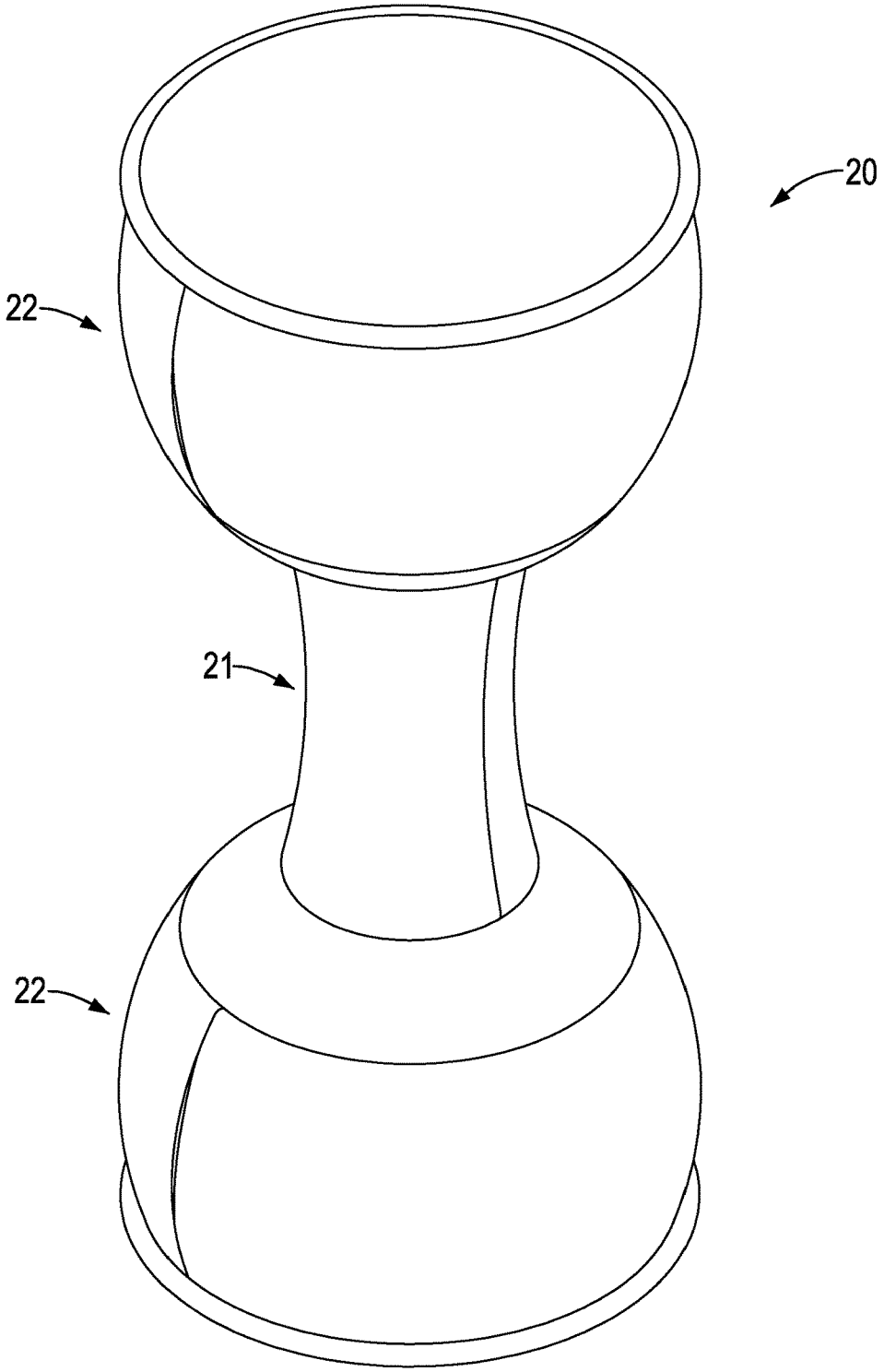
FIG. 1 is a perspective view of a first embodiment of a dumbbell in accordance with the present invention.

With reference to FIG. 1 to 5, a dumbbell in accordance with the present invention comprises a core rod 10 and a cloth cover 20.

The core rod 10 is elongated and has a supporting rod 11 and a bag 12. The supporting rod 11 is made of metal. The bag 12 is mounted around the supporting rod 11. The bag 12 has a top end and a bottom end. Two sealing portions 120 are respectively formed at the top end and the bottom end of the bag 12. A first filling space 101 is formed between the supporting rod 11 and the bag 12. The first filling space 101 is filled with a weight material 30. Preferably, the weight material 30 is iron sands.

The cloth cover 20 is mounted around the core rod 10. The cloth cover 20 has a holding portion 21 and two weight portions 22. The holding portion 21 is elongated and has two ends. The two weight portions 22 are respectively formed at the two ends of the holding portion 21. The two weight portions 22 are connected with the two sealing portions 120 respectively. A second filling space 102 is formed between the core rod 10 and the holding portion 21. A diameter of each one of the two weight portions 22 is larger than a diameter of the holding portion 21. The second filling space 102 is filled with the weight material 30. A respective third filling space 103 is formed between the core rod 10 and each one of the two weight portions 22. Preferably, the cloth cover 20 is made of neoprene which is the same material of which wetsuits are made.

Figure 2:
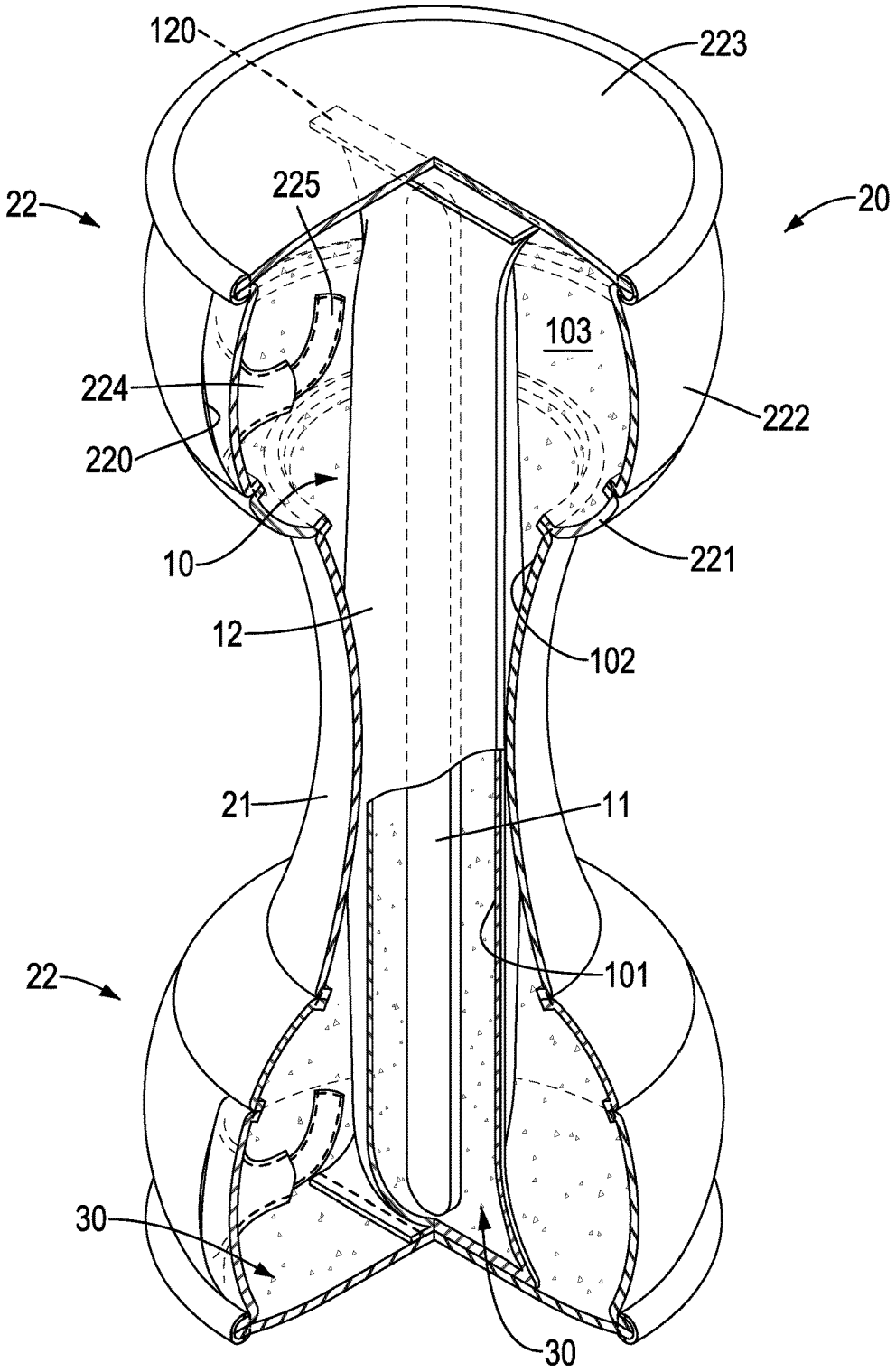
FIG. 2 is a perspective view in partial section of the first embodiment of the dumbbell in FIG. 1.
Figure 3:
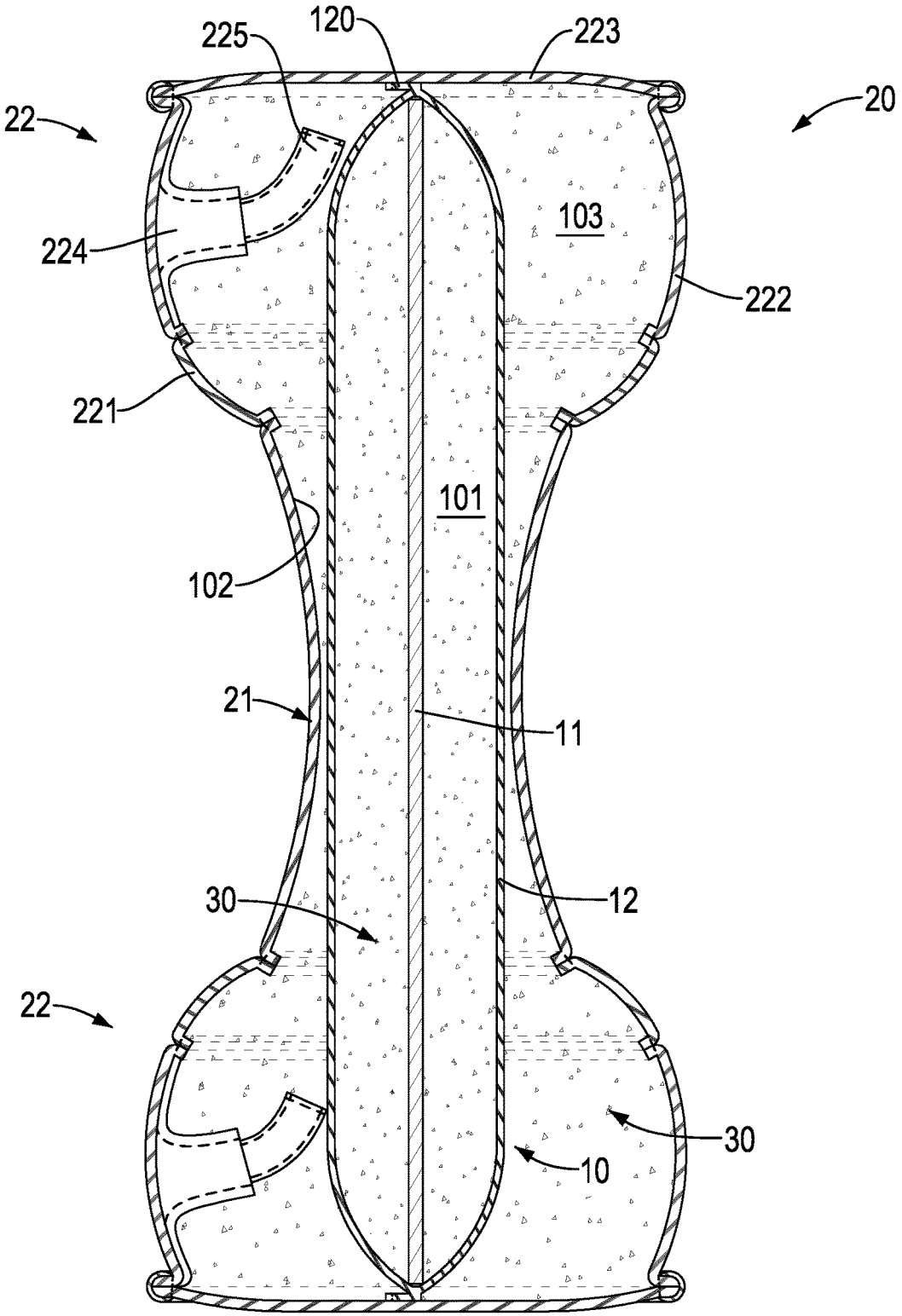
FIG. 3 is a cross sectional side view of the first embodiment of the dumbbell in FIG. 1.

With reference to FIGS. 2 and 3, in the first embodiment of the dumbbell, each one of the two weight portions 22 has an inner cloth 221, an annular cloth 222, and an outer cloth 223. The inner cloth 221 is annular and has an inner edge and an outer edge. A width of the inner edge of the inner cloth 221 is smaller than a width of the outer edge of the inner cloth 221. The inner edge of the inner cloth 221 is connected to the holding portion 21. The annular cloth 222 is connected to the outer edge of the inner cloth 221. The annular cloth 222 extends in the direction surrounding the core rod 10. The outer cloth 223 is connected to the annular cloth 222.

Figure 4:
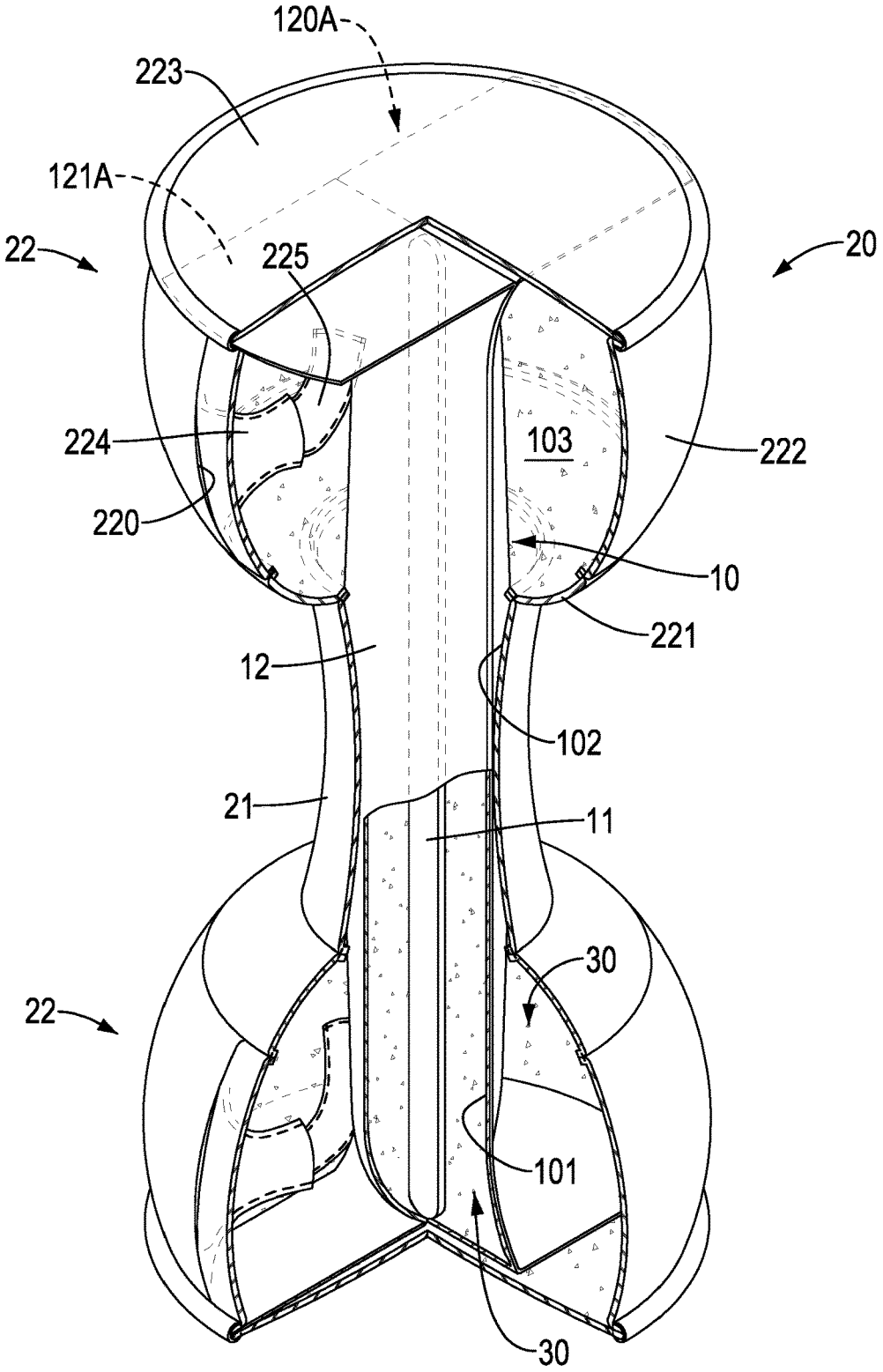
FIG. 4 is a perspective view in partial section of a second embodiment of a dumbbell in accordance with the present invention.
Figure 5:
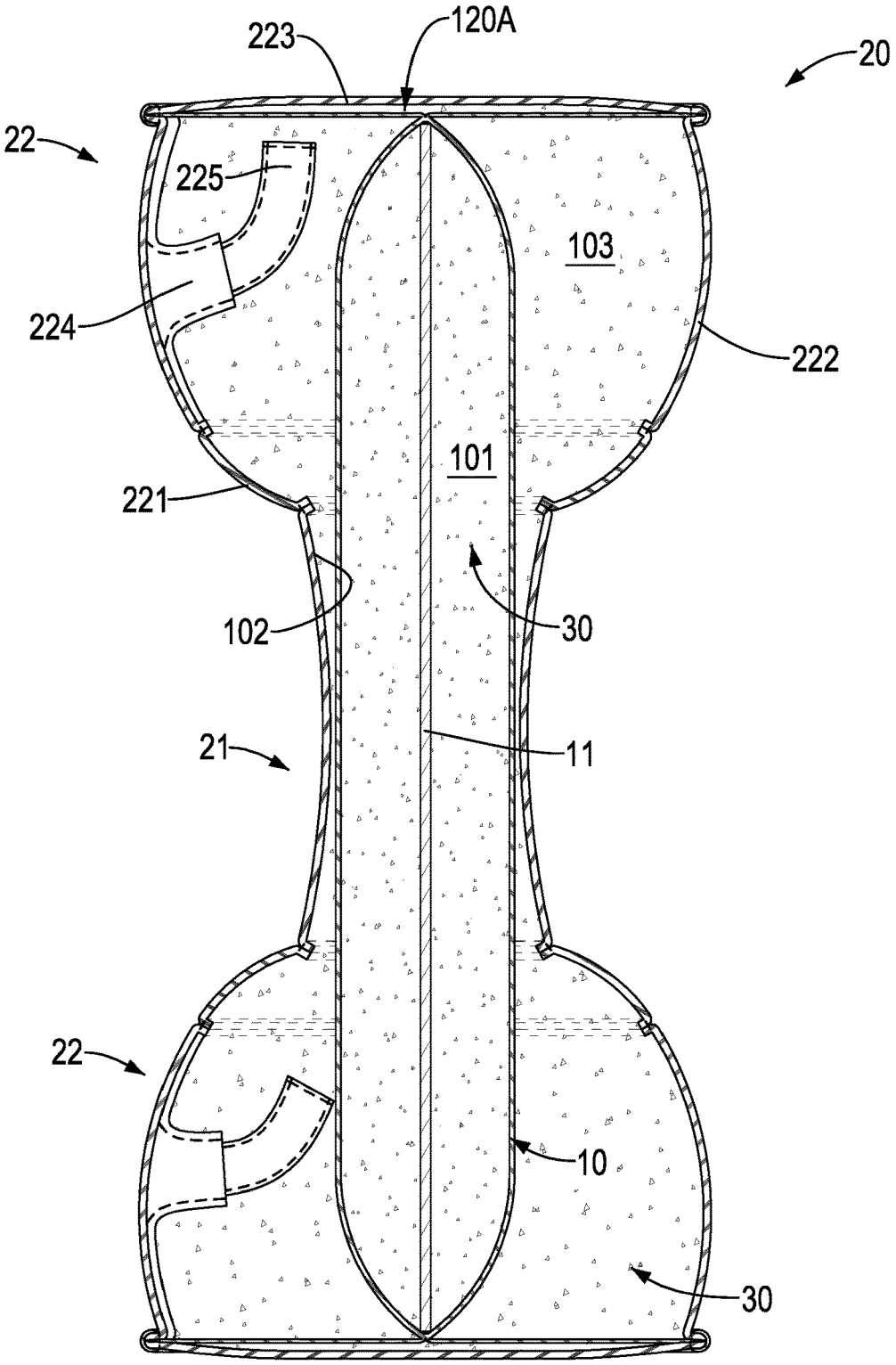
FIG. 5 is a cross sectional side view of the second embodiment of the dumbbell in FIG. 4.

With reference to FIGS. 4 and 5, in the second embodiment of the dumbbell, the two weight portions 22 are the same as those of the first embodiment. The difference between the first and the second embodiments is the two sealing portions 120A. Each one of the sealing portions 120A has two edge sides. The two edge sides of each sealing portion 120A are connected with an inner surface of the inner cloth 221.

Furthermore, in the first and second embodiments, the annular cloth 222 has an opening 220, an injecting tube 224, and an extending tube 225. The opening 220 is formed through the annular cloth 222. The injecting tube 224 is connected with the opening 220 and communicates with the third filling space 103. The weight material 30 may be put into the third filling space 103 via the injecting tube 224. The injecting tube 224 can be folded back and passes through the opening 220. The extending tube 225 is fixed to and communicates with the injecting tube 224.

Figure 6:
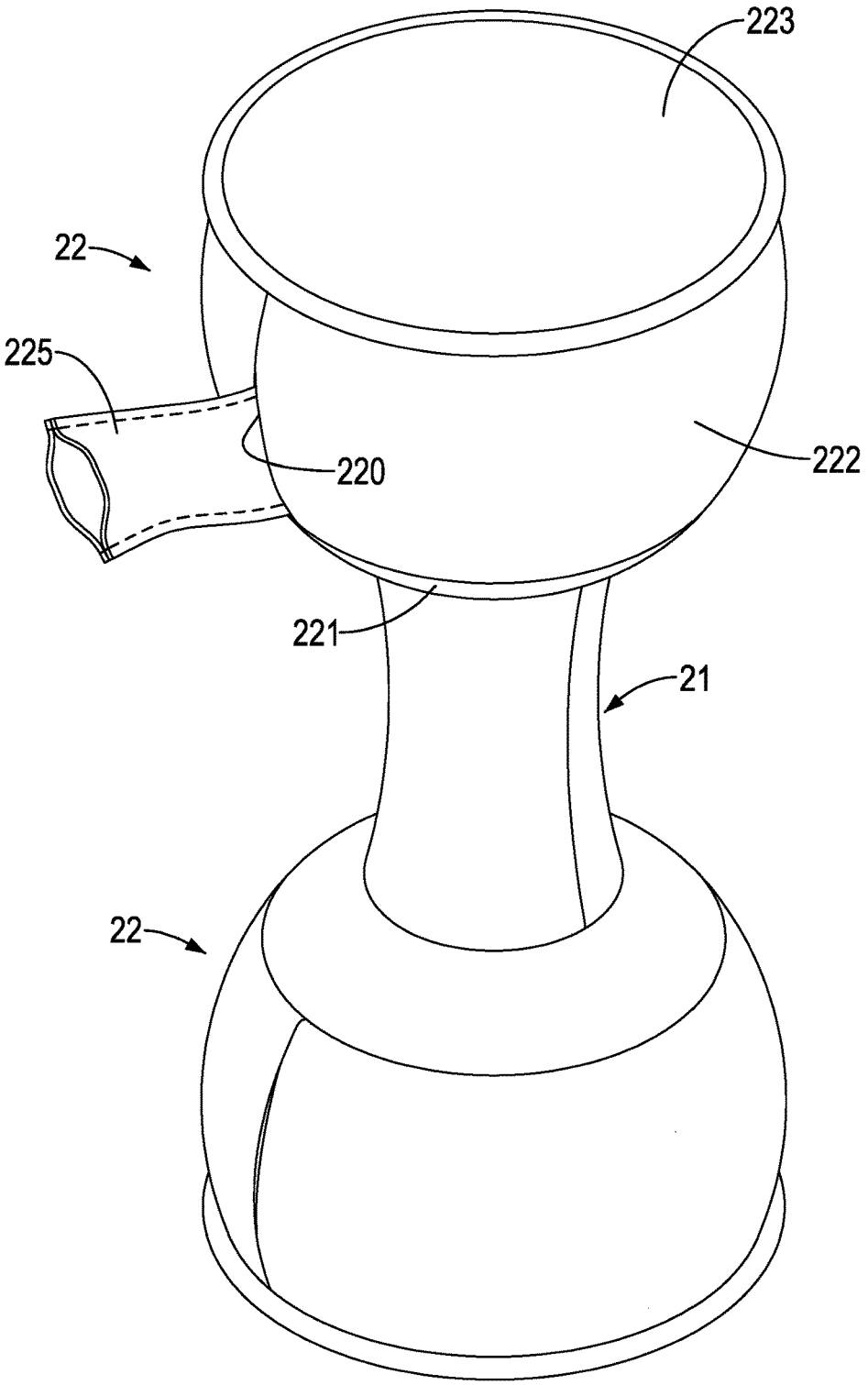
FIG. 6 is an operational perspective view of the first embodiment of the dumbbell in FIG. 1.
Figure 7:
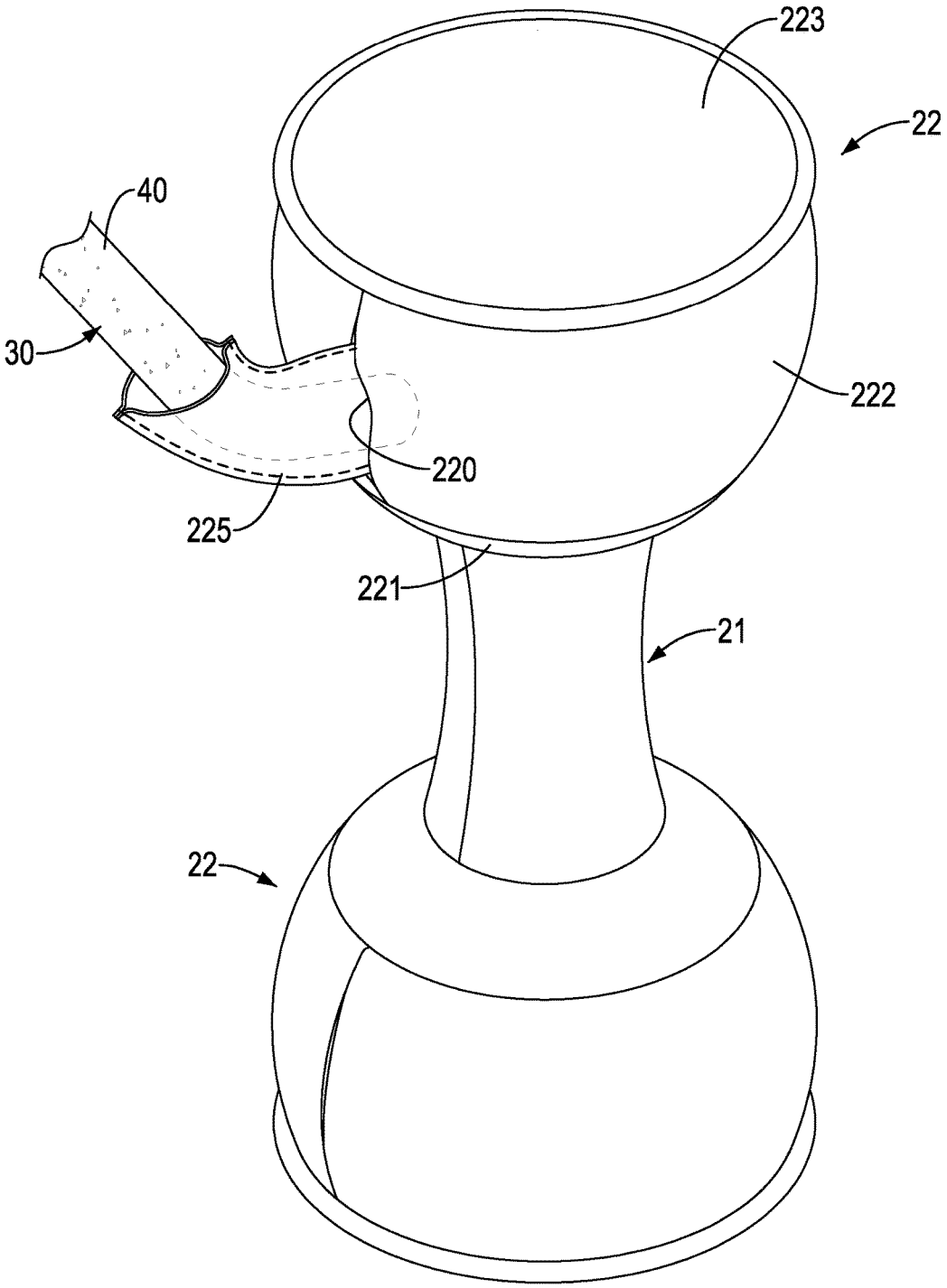
FIG. 7 is another operational perspective view of the first embodiment of the dumbbell in FIG. 1.
Figure 8:
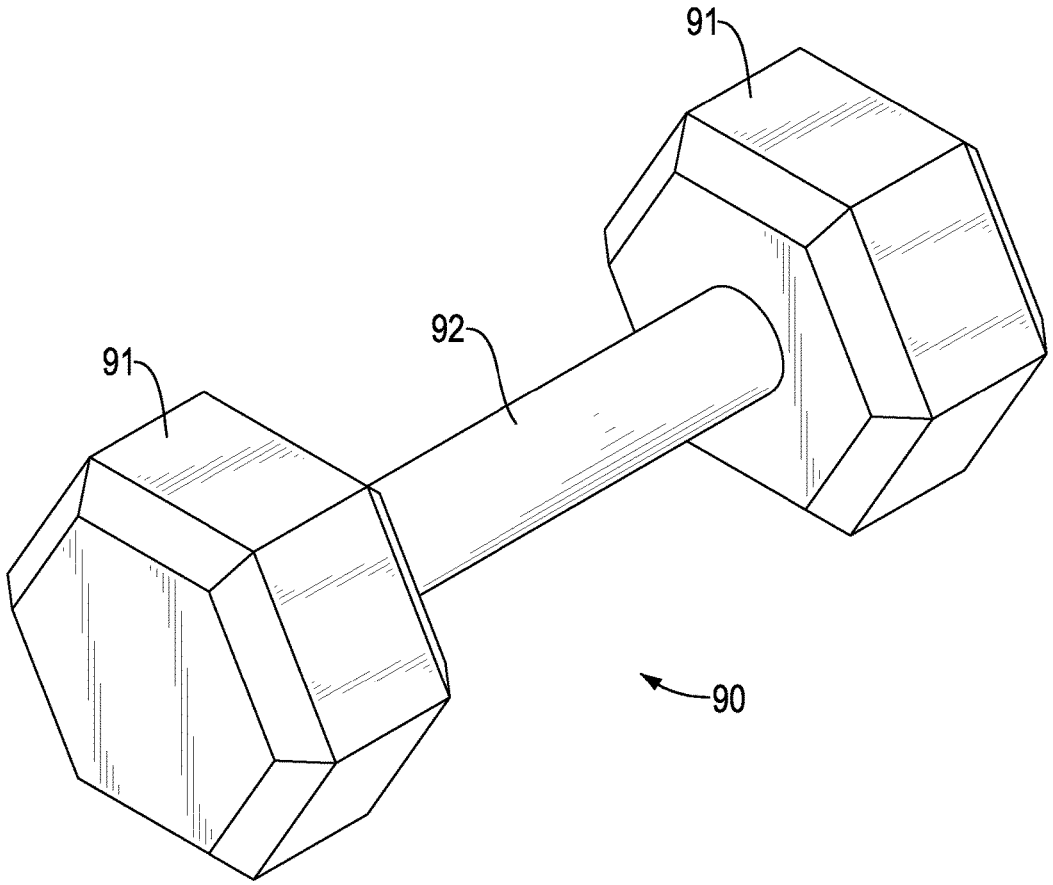
FIG. 8 PRIOR ART
FIG. 8 is a perspective view of a conventional dumbbell.

With reference to FIGS. 6 and 7, during manufacture of the dumbbell, the extending tube 225 and the injecting tube 224 are taken out from the weight portion 22. The weight material 30 is put into the second filling space 102 and the third filling spaces 103. Then, the extending tube 225 and the injecting tube 224 are folded and put into the third filling spaces 103 via the opening 220. Therefore, the extending tube 225 and the injecting tube 224 are enclosed inside the weight portion 22, thereby completing the dumbbell.

The cloth cover 20 is made of neoprene, and the second filling space 102 and the two third filling spaces 103 are filled with the weight material 30, and the weight material 30 is iron sands. Therefore, when the dumbbell falls onto the ground directly, the dumbbell would not scratch or damage the wooden floor.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A dumbbell comprising:

a core rod having a supporting rod; and a bag mounted around the supporting rod, and a first filling space formed between the supporting rod and the bag;

a cloth cover mounted around the core rod and having a holding portion being elongated and having two ends; and two weight portions respectively formed at the two ends of the holding portion, a second filling space formed between the core rod and the holding portion, a diameter of each one of the two weight portions being larger than a diameter of the holding portion, a respective third filling space formed between the core rod and each of the two weight portions, wherein the first filling space, the second filling spaces, and the two third filling spaces are filled with a weight material.

2. The dumbbell as claimed in claim 1, wherein each one of the two weight portions has an inner cloth having an inner edge and an outer edge, the inner edge of the inner cloth connected to the holding portion;

an annular cloth connected to the outer edge of the inner cloth; and an outer cloth connected to the annular cloth.

3. The dumbbell as claimed in claim 2, wherein the annular cloth has an opening formed through the annular cloth;

an injecting tube connected with the opening and communicating with the third filling space; and an extending tube fixed to and communicating with the injecting tube.

4. The dumbbell as claimed in claim 2, wherein the bag has a top end and a bottom end, two sealing portions are each respectively formed at the top end and the bottom end of the bag, each one of the sealing portions has two edge sides connected with an inner surface of the cloth cover.

5. The dumbbell as claimed in claim 1, wherein the weight material is iron sands.

6. The dumbbell as claimed in claim 2, wherein the weight material is iron sands.

7. The dumbbell as claimed in claim 3, wherein the weight material is iron sands.

8. The dumbbell as claimed in claim 4, wherein the weight material is iron sands.

9. The dumbbell as claimed in claim 1, wherein the cloth cover is made of neoprene.

10. The dumbbell as claimed in claim 2, wherein the cloth cover is made of neoprene.

11. The dumbbell as claimed in claim 3, wherein the cloth cover is made of neoprene.

12. The dumbbell as claimed in claim 4, wherein the cloth cover is made of neoprene.

* * * * *